US009742083B2

(12) United States Patent
Yamamoto et al.

(10) Patent No.: US 9,742,083 B2
(45) Date of Patent: Aug. 22, 2017

(54) CARD EDGE CONNECTOR

(71) Applicant: Molex, LLC, Lisle, IL (US)

(72) Inventors: Masahiro Yamamoto, Yamato (JP); Norihiro Nishi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/266,672

(22) Filed: Sep. 15, 2016

(65) Prior Publication Data

US 2017/0098903 A1 Apr. 6, 2017

(30) Foreign Application Priority Data

Oct. 2, 2015 (JP) ..... 2015-197045

(51) Int. Cl.
*H01R 27/00* (2006.01)
*H01R 12/72* (2011.01)
*H01R 13/52* (2006.01)

(52) U.S. Cl.
CPC ..... *H01R 12/721* (2013.01); *H01R 13/521* (2013.01); *H01R 13/5202* (2013.01); *H01R 13/5219* (2013.01)

(58) Field of Classification Search
CPC ..... H01R 27/00; H01R 13/5221; H01R 13/2442; H01R 13/5219; H01R 13/5202; H01R 13/5208; H01R 13/5205; H01R 13/4361; H01R 13/4362; G06K 7/0021
USPC ..... 439/630, 275, 271, 682
See application file for complete search history.

(56) References Cited

U.S. PATENT DOCUMENTS 6,033,265 A * 3/2000 Yeh ..... H01R 23/70 439/638
6,159,053 A * 12/2000 Tung ..... H01R 31/06 439/636
6,164,989 A * 12/2000 Glad ..... H01R 13/447 439/131
6,203,378 B1 * 3/2001 Shobara ..... H01R 31/005 439/141
6,547,603 B1 * 4/2003 Yu ..... H01R 31/06 439/638
6,679,739 B2 * 1/2004 Fujita ..... H01R 13/11 439/637
7,101,188 B1 * 9/2006 Summers ..... H01R 12/725 439/59
7,118,423 B2 * 10/2006 Kobayashi ..... H01R 31/085 439/638
7,686,654 B2 * 3/2010 Hubert ..... H05K 5/0265 361/737
8,075,343 B2 * 12/2011 Fu ..... H01R 12/721 439/328
9,379,475 B2 * 6/2016 Endo ..... H01R 13/516
(Continued)

FOREIGN PATENT DOCUMENTS

JP 2014-044879 A 3/2014

*Primary Examiner* — Gary Paumen
(74) *Attorney, Agent, or Firm* — James A. O'Malley

(57) ABSTRACT

A card edge connector is provided which includes a housing mated with a card having connecting electrodes. The housing includes a first housing having first terminals mounted to contact the connecting electrodes and a second housing having second terminals connected to a core wire in a conductive wire. The first terminals and the second terminals contact each other under a predetermined amount of contact pressure when the first housing and the second housing are connected.

5 Claims, 11 Drawing Sheets

(56) References Cited

U.S. PATENT DOCUMENTS

| | | | | |
|---|---|---|---|---|
| 2005/0164556 | A1* | 7/2005 | Lutsch | H01R 13/113 439/332 |
| 2005/0186855 | A1* | 8/2005 | Shimizu | H01R 12/716 439/682 |
| 2007/0004285 | A1* | 1/2007 | Lee | H05K 5/0282 439/638 |
| 2008/0076302 | A1* | 3/2008 | Chi | G06K 19/077 439/638 |
| 2008/0153358 | A1* | 6/2008 | Tanaka | G06K 7/0021 439/638 |
| 2008/0305688 | A1* | 12/2008 | Lin | H01R 12/721 439/638 |
| 2009/0004920 | A1* | 1/2009 | Hubert | H01R 31/06 439/638 |
| 2009/0004921 | A1* | 1/2009 | Hubert | G06K 19/07741 439/638 |
| 2009/0061690 | A1* | 3/2009 | Cheng | H01R 31/06 439/638 |
| 2009/0104818 | A1* | 4/2009 | Wu | H01R 12/721 439/638 |
| 2013/0237092 | A1* | 9/2013 | Rubens | H01R 13/6596 439/607.23 |

* cited by examiner

FIG. 1A
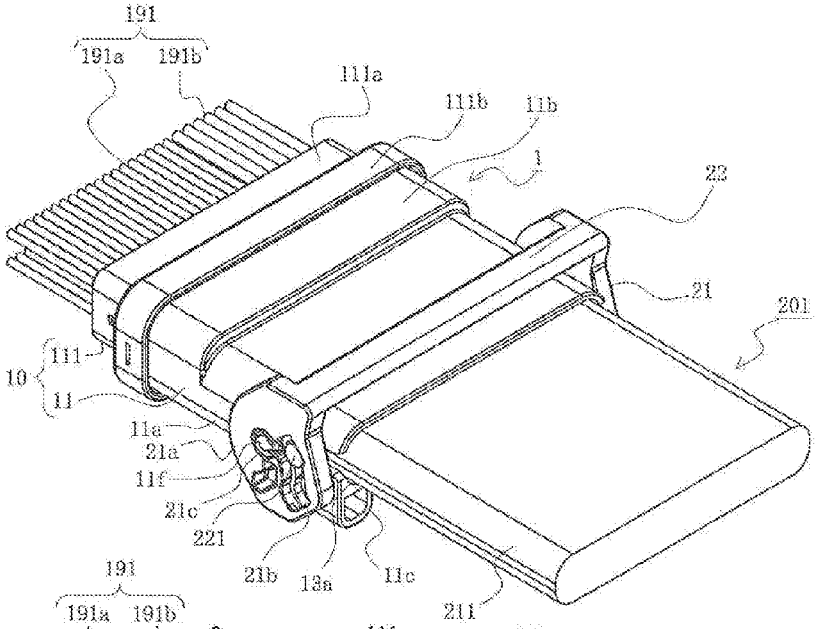
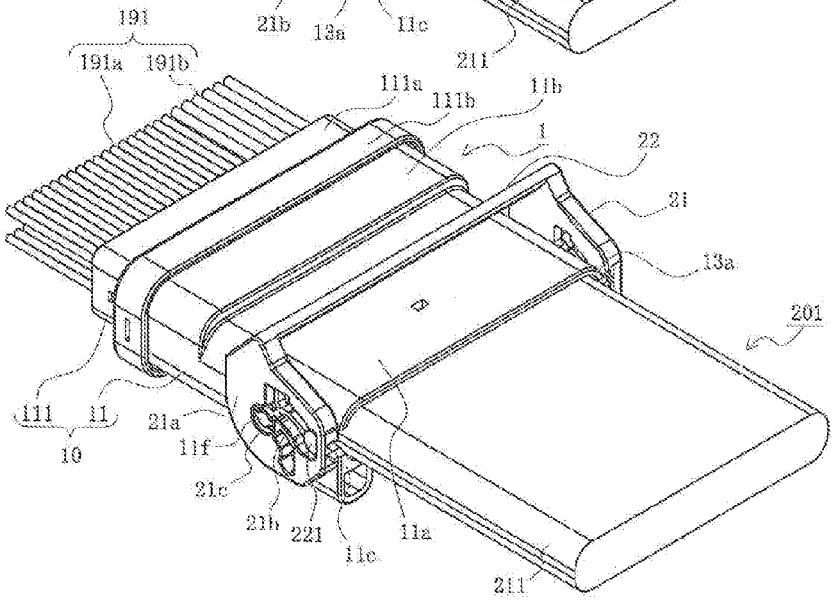
FIG. 1B

A
A
201
22
21
1
211
191b
191a
191
111
11
10
11b
221
21a
11f
21
21b
21c
111a
191a
111b
11
113
113b
111a
191b
191

FIG. 9A
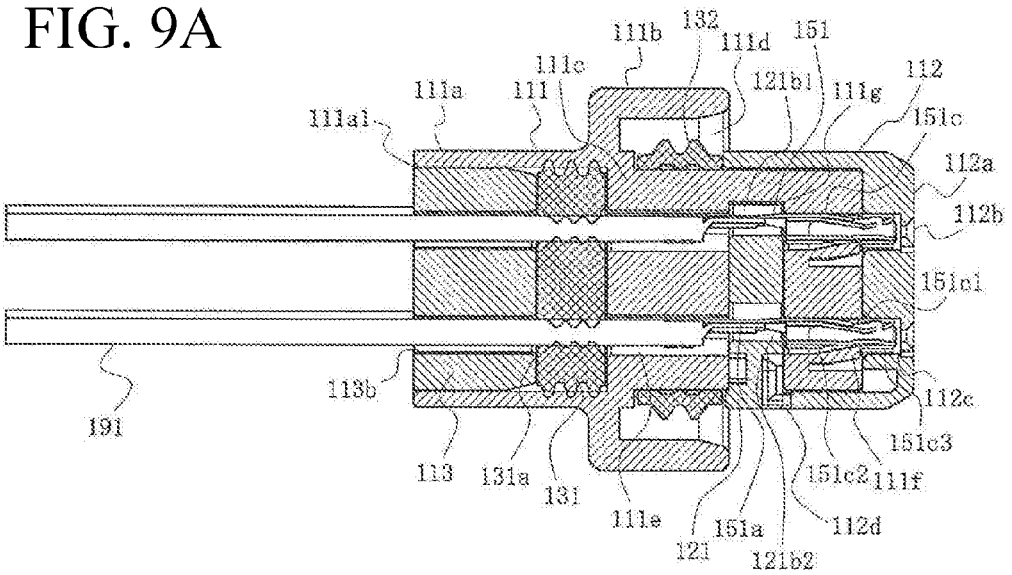
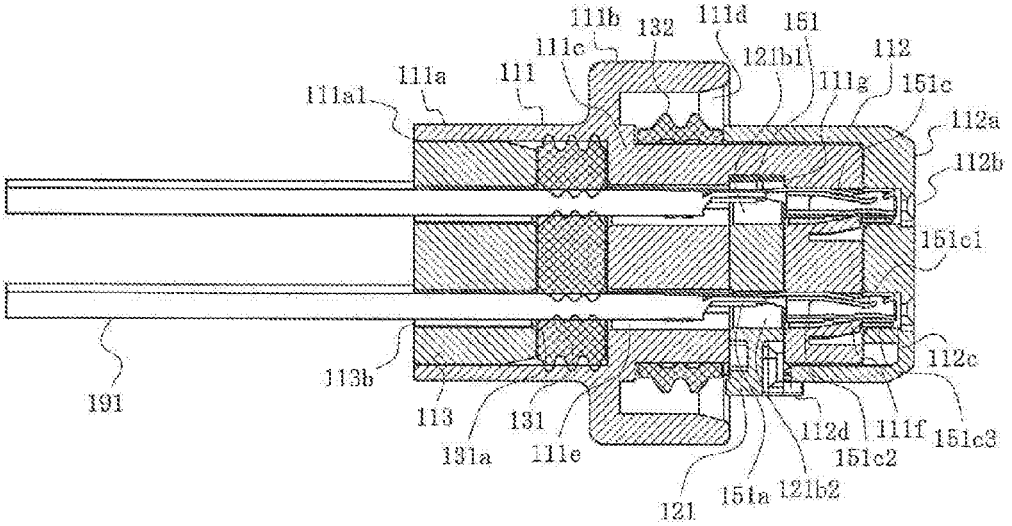
FIG. 9B

CARD EDGE CONNECTOR

RELATED APPLICATIONS

This application claims priority to Japanese Application No. 2015-197045, filed Oct. 2, 2015, which is incorporated herein by reference in its entirety.

TECHNICAL FIELD

The present disclosure relates to a card edge connector.

BACKGROUND ART

Card edge connectors are a type of connector in which a card edge, usually the front edge of a card including a board such as a printed circuit board, is inserted directly into a plug portion and mated (see, for example, Patent Document 1).

FIG. 11 is a cross-sectional view of a card edge connector of the prior art.

As shown in the drawing, the card edge connector has a housing 811 made of an insulating material such as a synthetic resin, and a plurality of conductive wires 991 are inserted into the housing 811 from the rear. Among these conductive wires 991, a second terminal 951 is connected to the leading end of the conductive wires 991 positioned to the outside (the upper and lower sides in the drawing), and the second terminals 951 are mated with the rear end of a first terminal 851 housed inside an accommodating portion 817 formed in the housing 811.

The housing 811 is covered by an exterior portion 812, an opening 813 is formed in the front surface, and a card leading edge accommodating space 814 is formed inside the opening 813. The card leading edge accommodating space 814 receives the inserted card edge (not shown), and the leading ends of the first terminals 851 are exposed in order to come into contact with contact pads on the surface of the card edge.

A first seal member 841 and a second seal member 941 are attached near the rear end of the housing 811 to provide a waterproof seal. The conductive wires 991 are passed through through-holes formed in the second seal member 941.

Patent Document 1: Japanese Patent Publication No. 2014-044879

SUMMARY

In a card edge connector of the prior art, the conductive wires 991 connected on the leading end to second terminals 951 are passed through through-holes in the second seal member 941 at the rear of the housing 811. After the second terminals 951 have been housed in the accommodating portion 817, the rear end of each first terminal 851 is inserted into the accommodating portion 817 from the front of the housing 811 and mated with the corresponding second terminal 951. As a result, each small first terminal 851 has to be inserted one at a time into the accommodating portion 817 and mated with the corresponding second terminal 951. Because this operation has to be repeated many times, the assembly operation is complicated and time-consuming.

In order to maintain good contact between the rear ends of the first terminals 851 and the second terminals 951, the contact pressure has to be increased between the rear ends of the first terminals 851 and the second terminals 951. However, enough pressure to overcome resistance cannot be applied to the first terminals 851 each time a small first terminal 851 is inserted into the accommodating portion 817 and mated with the corresponding second terminal 951. Because the contact pressure between the rear end of the first terminals 851 and the second terminals 951 has to be reduced, the possibility of poor contact between the rear end of the first terminals 851 and the second terminals 951 is high.

The present disclosure solves the problem associated with card edge connectors of the prior art by providing a reliable, durable, low-cost card edge connector able to maintain good assembly workability even when the contact pressure between first terminals and second terminals is increased and which maintains good contact between the first terminals and the second terminals.

The present disclosure is a card edge connector including a housing mated with a card having connecting electrodes, the housing comprising a first housing having first terminals mounted to contact the connecting electrodes and a second housing having second terminals connected to a core wire in a conductive wire, and the first terminals and the second terminals contacting each other under a predetermined amount of contact pressure when the first housing and the second housing are connected.

In a card edge connector according to another aspect of the present disclosure, the card is mated with the first housing in a water-tight manner, the conductive wire is connected to the second housing in a water-tight manner, and the first housing and the second housing are connected in a water-tight manner.

In a card edge connector according to another aspect of the present disclosure, the first housing includes a second housing accommodating cavity having an opening in the rear end, and a first terminal holding portion positioned on the front end of the second housing accommodating cavity, each first terminal has a main body portion held by the first terminal holding portion, and a tail portion extending to the rear from the rear end of the main body portion, at least the rear end protruding into the second housing accommodating cavity to the rear of the first terminal holding portion, the second housing includes a forward portion having second terminal accommodating holes for holding the second terminals, each second terminal has a main body portion connected to a core wire of the conductive wire, and a contact portion connected to the leading end of the main body portion, and the forward portion being housed inside the second housing accommodating cavity and the tail portions contacting contact portions when the first housing and the second housing are connected.

In a card edge connector according to another aspect of the present disclosure, the second housing has a retainer able to move between an open position enabling the second terminals to move and a closed position preventing movement of the second terminals, the retainer being unable to move in the closed position when the first housing and the second housing are connected.

In a card edge connector according to another aspect of the present disclosure, each first terminal has a contact portion contacting a connecting electrode when the card is mated with the first housing, each contact portion has a contact flat portion as well as a first curved portion and a second curved portion connected to both ends of the contact flat portion whose side profile resembles a semi-circle, and the first curved portion and the second curved portion function as a spring when the contact flat portions contact a connecting electrode.

The card edge connector in the present disclosure is able to maintain good assembly workability even when the contact pressure between first terminals and second terminals is increased. In this way, good contact can be maintained between the first terminals and the second terminals. The result is a reliable, durable, low-cost card edge connector.

BRIEF DESCRIPTION OF THE DRAWINGS

FIGS. 1A and 1B are a pair of perspective views showing a card mated with a card edge connector in an embodiment of the present disclosure, in which FIG. 1A shows the situation when the lock lever is in the closed position and FIG. 1B shows the situation when the lock lever is in the open position.

FIGS. 2A-2D are four views showing a card mated with a card edge connector in the embodiment of the present disclosure, in which FIG. 2A is a top view, FIG. 2B is a rear view, FIG. 2C is a side view, and FIG. 2D is a bottom view.

FIGS. 3A and 3B are a pair of perspective views before a card has been mated with a card edge connector in the embodiment of the present disclosure, in which FIG. 3A is a view from the card side and FIG. 3B is a view from the card edge connector side.

FIGS. 6A and 6B are a pair of perspective views before the first housing and the second housing have been connected in the card edge connector of the present embodiment, in which FIG. 6A is a view from the first housing side and FIG. 6B is a view from the second housing side.

FIGS. 9A and 9B are a pair of cross-sectional views of the second housing in the card edge connector of the present embodiment from arrows C-C in FIG. 6B, in which FIG. 9A shows the situation when the retainer is in the closed position and FIG. 9B shows the situation when the retainer is in the open position.

FIGS. 10A and 10B are a pair of perspective views of the retainer removed from the second housing in the card edge connector of the present embodiment, in which FIG. 10A is a view from above and FIG. 10B is a view from below.

DETAILED DESCRIPTION OF THE PREFERRED EMBODIMENTS

Figures 2A, 2B, 2C, 2D:
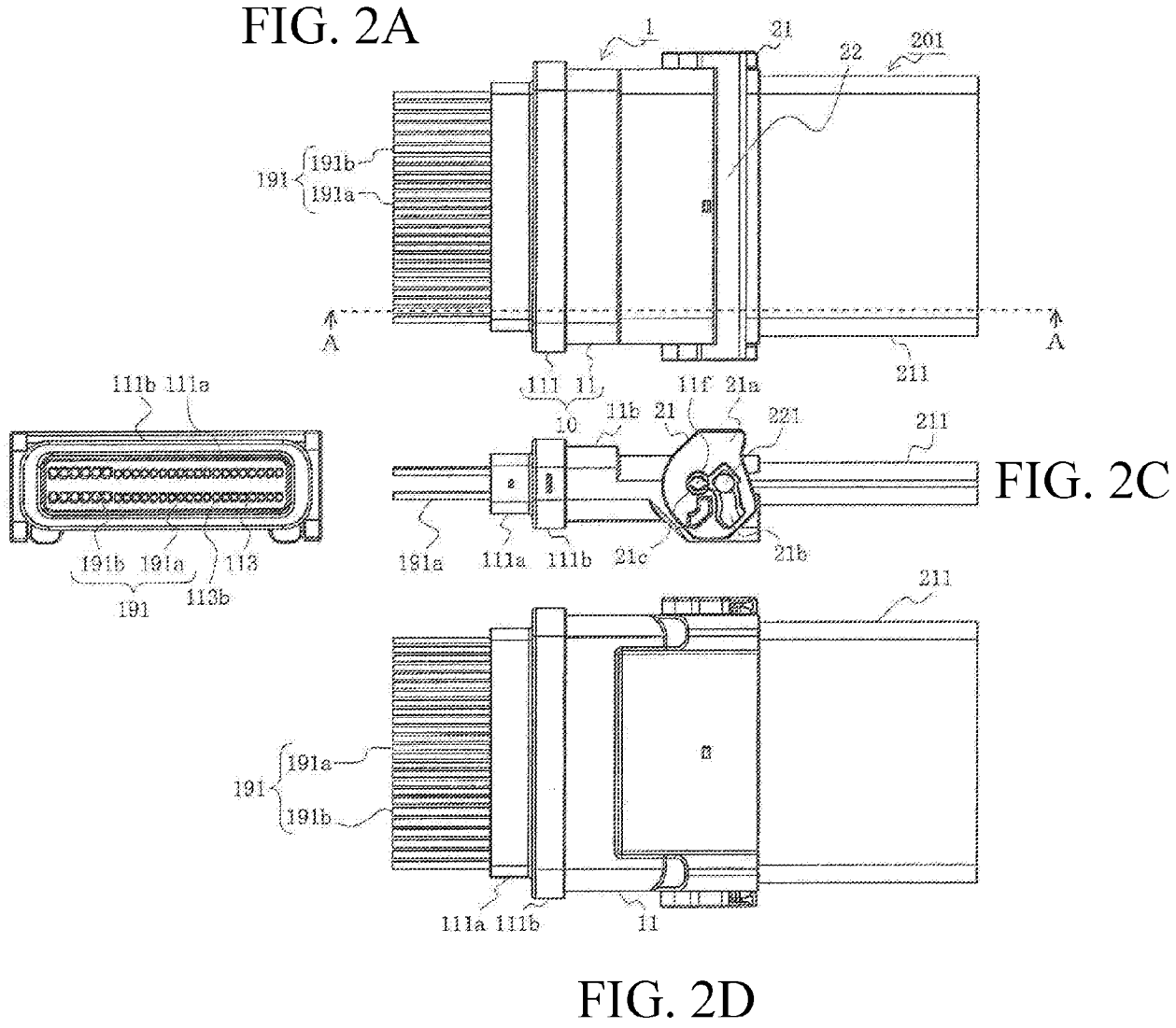

The following is a detailed description of an embodiment with reference to the drawings.

In the drawings, 1 is the connector serving as the card edge connector in the present embodiment. The front end (the lower right end in FIG. 3A) is mated with the opposing unit 201 serving as the card. The opposing unit 201 can be any type of unit having a board portion 214 protruding from one end. Examples include memory cards containing semiconductor memory, portable hard disk units containing a small hard disk device, and small control units containing semiconductor memory and a computing element such as a CPU or an MPU.

Figure 3A:
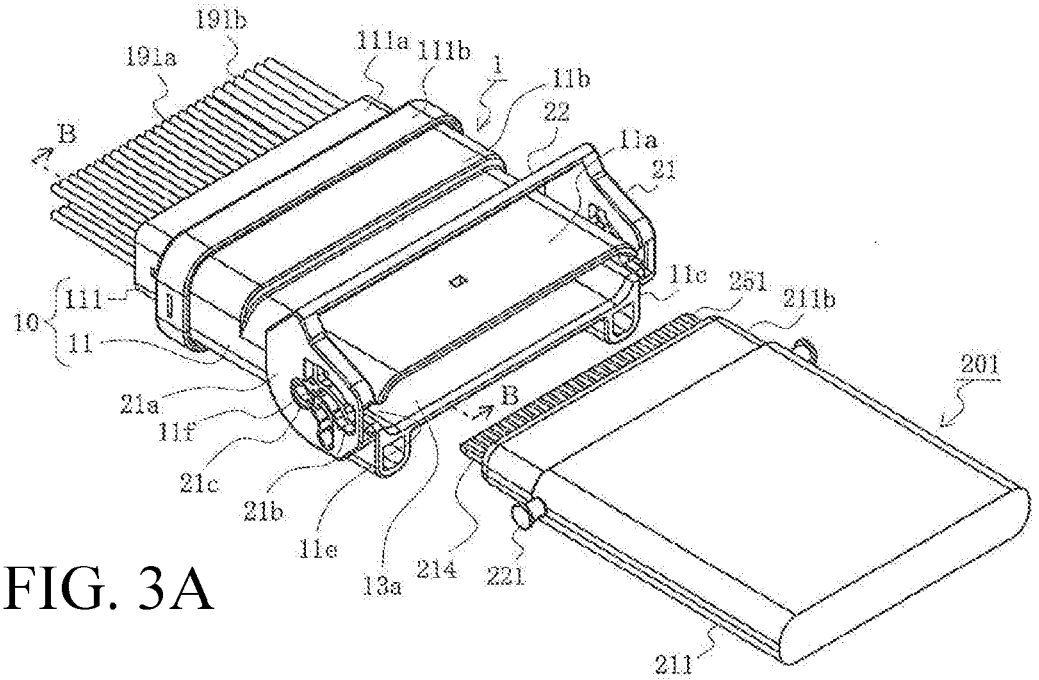
Figure 3B:
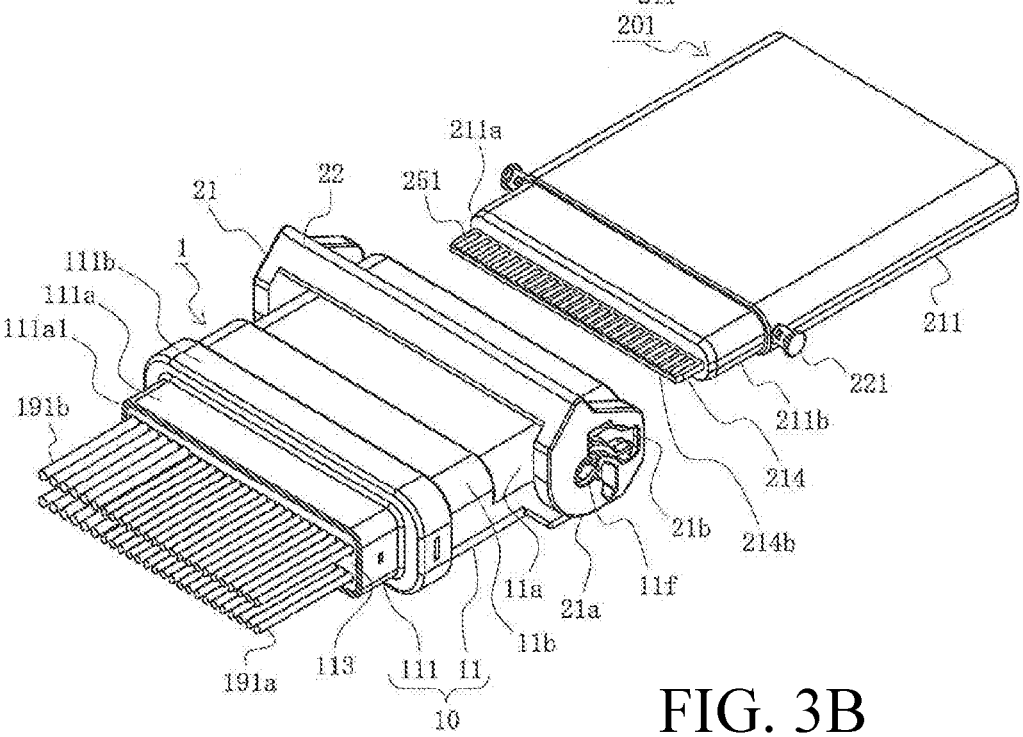

As shown in FIGS. 3A and 3B, the opposing unit 201 has a flat, panel-like main body portion 211, an inserted portion 211*b* extending forward from the main body portion 211, and a board portion 214 extending forward from the front end 211*a* of the inserted portion 211*b*. The inserted portion 211*b* is somewhat thinner than the main body portion 211. The board portion 214 is a panel-like member such as a printed circuit board, and the edge near the front end 214*b* is exposed beyond the front end 211*a* of the inserted portion 211*b*. Both the upper and lower surfaces of the board portion 214 on the edge have exposed conductive electrode pads 251 extending in the longitudinal direction of the opposing unit 201 and arranged side by side in the width direction to serve as conductive electrodes. Each electrode pad 251 is connected electrically to a conductive trace (not shown) on the board portion 214. Locking protrusions 221 extend outward from both the left and right side edges of the main body portion 211. The outer periphery of the opposing unit 201 is coated in an insulating material such as a resin except where the electrode pads 251 are located.

The connector 1 has a plurality of housings 10 consisting of a first housing 11 made of an insulating material such as a resin connected to a second housing 111 made of an insulating material such as a resin. The first housing 11 has a plurality of conductive first terminals 51, and the second housing 111 has a plurality of conductive second terminals 151. When the first housing 11 and the second housing 111 are connected, the first terminals 51 and corresponding second terminals 151 are brought into contact with each other by the application of a predetermined amount of contact pressure to establish an electrical connection. In the second housing 111, the leading ends of a plurality of conductive wires 191 arranged side by side in the width direction to form two levels, an upper level and a lower level, are inserted from the rear of the second housing 111 and connected. The base end of a main body portion 151*a* of a second terminal 151 is connected to the leading end of each conductive wire 191, and the conductive core wire (not shown) of each conductive wire 191 is connected electrically to a main body portion 151*a*.

In the example shown in the drawings, the conductive wires 191 include narrow-diameter conductive wires 191*a* and thick-diameter conductive wires 191*b* that are thicker than the narrow-diameter conductive wires 191*a*. However, the conductive wires may all be one type or the other. In the following explanation, both the narrow-diameter conductive wires 191*a* and the thick-diameter conductive wires 191*b* are referred to collectively as conductive wires 191. The conductive wires 191 do not have to be a bundle of individual wires each containing a single core wire. They may also take the form of a flexible flat cable (FFC) in which a plurality of core wires are arranged in parallel.

In the present embodiment, the expressions indicating direction, such as upper, lower, left, right, front and rear, which are used to explain the configuration and operation of each portion of the connector 1 and the opposing unit 201 are relative and not absolute. They depend on the orientation of the connector 1, the opposing unit 201, and their constituent components shown in the drawings. When the orientation of the connector 1, the opposing unit 201, or their constituent components changes, the interpretation changes in response to the change in orientation.

The first housing 11 includes a forward portion 11*a* mated with the opposing unit 201, and a rear portion 11*b* connected to the second housing 111. A card accommodating cavity 13*a* with an opening in the front end 11*c* is formed in the forward portion 11*a*. Also, a pivot 11*f* extending outward is attached to both the left and right side ends of the forward portion 11*a*, and a lock lever 21 whose orientation can be changed is attached to the pivots 11*f*. The lock lever 21 has a pair of left and right flat pivot members 21*a* and a rod-like operating member 22 connected to the left and right pivot members 21*a*. A shaft hole 21*c* is formed in each pivot member 21*a* which passes through the pivot member 21*a* in the thickness direction, and the shaft holes 21*c* are rotatably fitted into the pivots 11*f*. In this way, the left and right pivot members 21*a* are able to pivot around the pivots 11*f*, and the orientation of the lock lever 21 can be switched between the closed position shown in FIG. 1A and the open position shown in FIG. 1B.

A narrow groove portion 21*b* is formed in the pivot members 21*a* which passes through the pivot member 21*a* in the thickness direction. As shown in FIGS. 3A and 3B, one end of each groove portion 21*b* communicates with a notch portion 11*e* formed in the left and right side ends of the forward portion 11*a* near the front end 11*c* when the lock lever 21 is in the open position. When the inserted portion 211*b* of the opposing unit 201 has been inserted into the card accommodating cavity 13*a*, the locking protrusions 221 on the opposing unit 201 pass through the notch portions 11*e* and, as shown in FIG. 1B, reach the groove portions 21*b*. In this way, a section of the main body portion 221 of the opposing unit 201 can be inserted into the card accommodating cavity 13*a* in addition to the inserted portion 211*b*. When the lock lever 21 reaches the closed position as shown in FIG. 1A, the locking protrusions 221 are sealed inside the groove portions 21*b*, and the opposing unit 201 is locked while mated with the forward portion 11*a* and cannot be detached from the connector 1.

Figure 4:
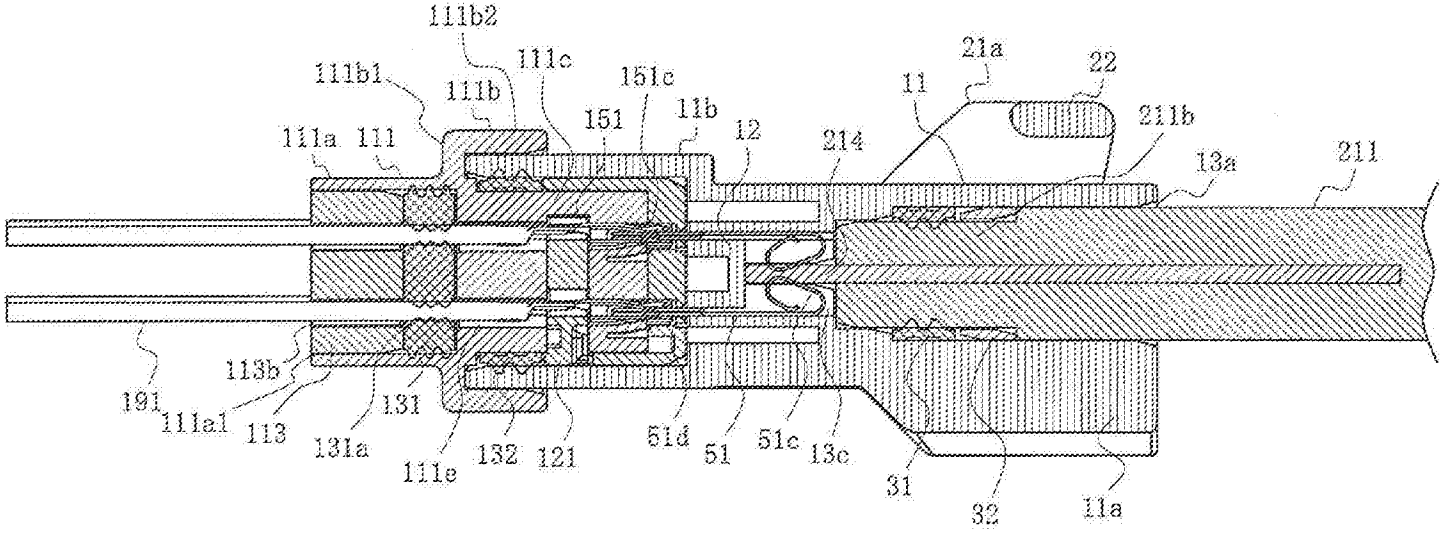
FIG. 4 is a cross-sectional view showing another connector mated with a card edge connector in the embodiment of the present disclosure from arrows A-A in FIG. 2A.

A first terminal contact cavity 13*c* is formed inwardly, that is, towards the rear (the left in FIG. 4 and FIG. 5), in the card accommodating cavity 13*a*, and communicates with the card accommodating cavity 13*a*. As shown in FIG. 4, when the opposing unit 201 is mated with the forward portion 11*a*, the inserted portion 211*b* is inserted into the card accommodating cavity 13*a*, and the board portion 214 is inserted into the first terminal contact cavity 13*c*.

Figure 5:
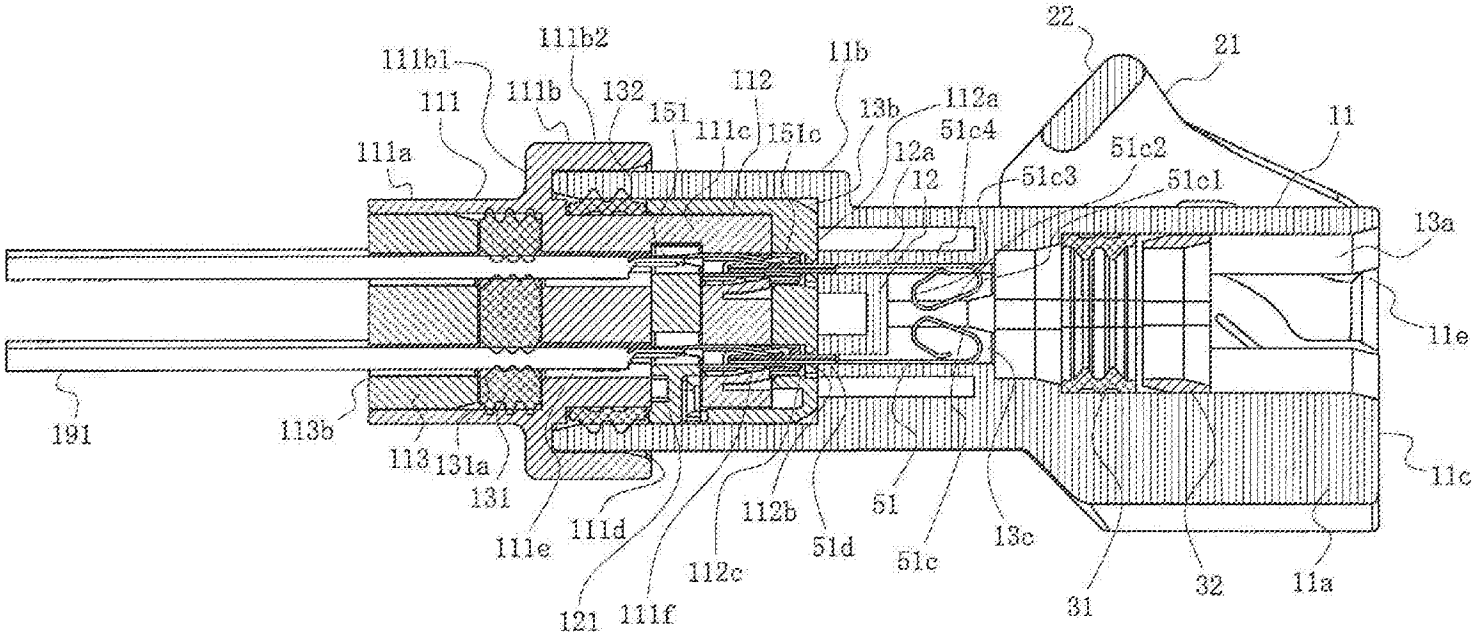
FIG. 5 is a cross-sectional view of a card edge connector in the embodiment of the present disclosure from arrows B-B in FIG. 3A.
Figure 6A:
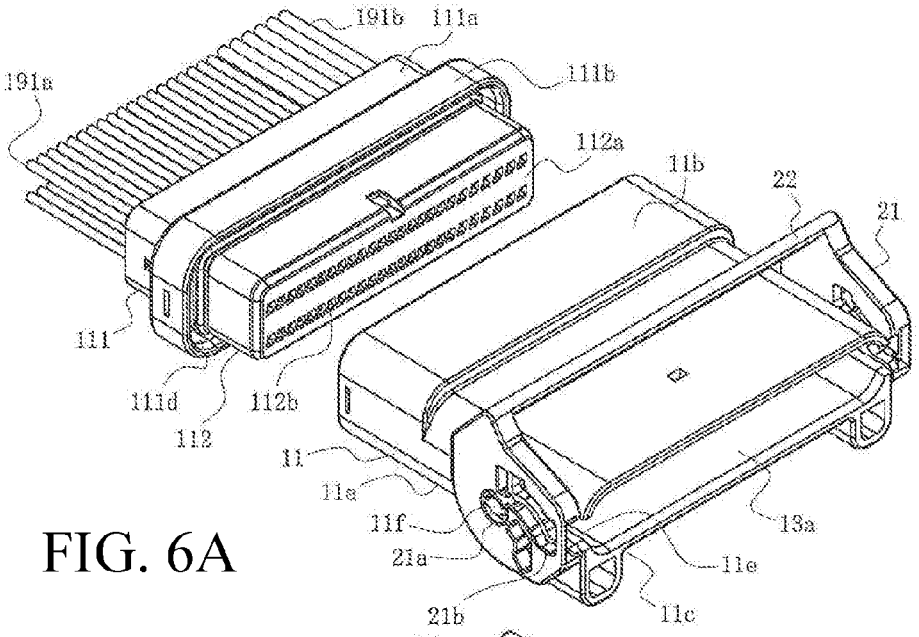
Figure 6B:
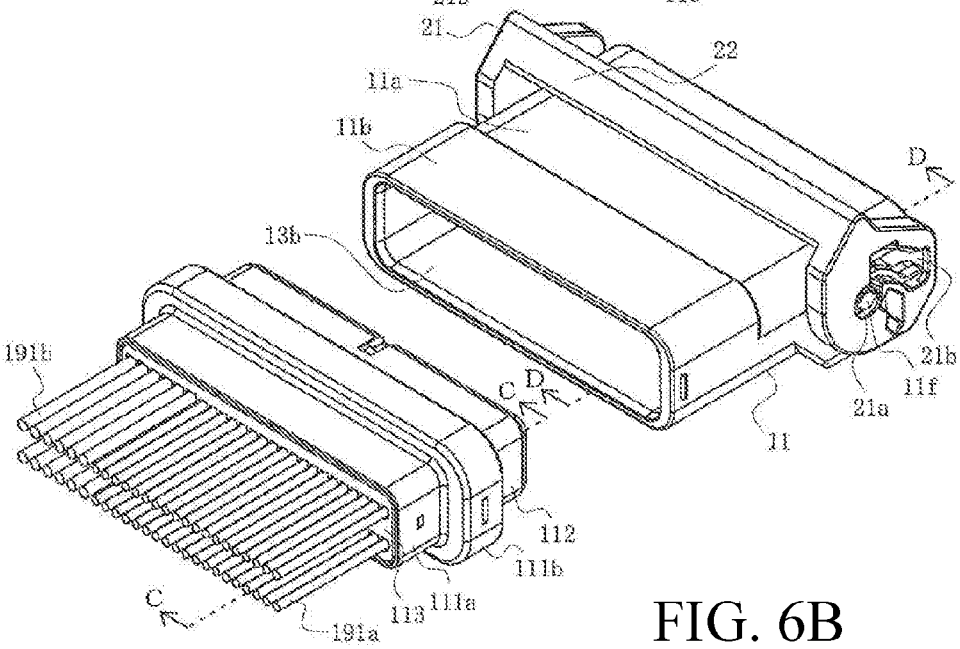

Also, a plurality of first terminal accommodating holes 12*a*, arranged side by side in two levels, an upper level and a lower level, in the transverse direction and extending in the longitudinal direction, are formed in a first terminal holding portion 12 defining the rear end of the first terminal contact cavity 13*c*. As shown in FIG. 5, at least the base end (rear end) of the main body portion 51*a* of each first terminal 51 is accommodated and held in each first terminal accommodating hole 12*a*, and the leading end and the contact portion 51*c* connected integrally to the leading end of the main body portion 51*a* of each first terminal 51 is positioned inside the first terminal contact cavity 13*c*. The contact portions 51*c* of the first terminals 51 arranged in the upper level and the contact portions 51*c* of the first terminals 51 arranged in the lower level oppose each other inside the first terminal contact cavity 13*c* and, as shown in FIG. 4, make contact with electrode pads 251 exposed on the top and bottom surfaces of the board portion 214 with the board portion 214 interposed between these levels.

As shown in FIG. 5, each contact portion 51*c* has a first curved portion 51*c*1 curving nearly 180 degrees from the leading end of the main body portion 51*a* and having a nearly semi-circular side profile, a contact flat portion 51*c*2 extending on an incline from the rear end of the first curved portion 51*c*1, a second curved portion 51*c*3 curving nearly 180 degrees from the rear end of the contact flat portion 51*c*2 and having a nearly semi-circular side profile, and a main body abutting portion 51*c*4 connected to the leading end of the second curved portion 51*c*3 whose leading end is able to abut the main body portion 51*a*.

While not clearly depicted in FIG. 4, when the board portion 214 is inserted between the opposing contact portions 51*c*, the interval between the second curved portions 51*c*3 closest to each other is pushed apart, nearly all of the main body abutting portion 51*c*4 abuts the main body portion 51*a*, the contact flat portion 51*c*2 becomes nearly parallel to the main body portion 51*a*, and the upper and lower contact portions 51*c* become oval shaped with the long axis nearly parallel to the main body portion 51*a*. In this way, the contact flat portions 51*c*2 contacting electrode pads 251 on the board portion 214 are elastically supported on both ends by first curved portions 51*c*1 and second curved portions 51*c*3 that have a nearly semi-circular side profile. The first curved portions 51*c*1 and second curved portions 51*c*3 with a nearly semi-circular side profile function as soft springs and both ends are supported by soft springs. As a result, the contact pressure between the contact flat portions 51*c*2 and the electrode pads 251 on the board portion 214 do not change very much even when the amount of vertical displacement is significant. Therefore, contact between the contact flat portions 51*c*2 and the electrode pads 251 remain under a predetermined amount of contact pressure, the contact resistance remains, low, good, and reliable even when there is some discrepancy in the board portion 214 in the thickness dimension, and the distance between electrode pads 251 arranged on both surfaces of the board portion 214 varies.

The tail portion 51*d* extending to the rear from the rear end of the main body portion 51*a* of each first terminal 51 has the shape of a slender rod, and at least the leading end (rear end) protrudes to the rear from the rear end of the first terminal holding portion 12 and makes contact with a contact portion 151*c* integrally connected to the leading end of the main body portion 151*a* of a second terminal 151.

A ring-shaped first seal member 31 made of an elastic resin such as rubber is attached inside the card accommodating cavity 13*a* so as to be fitted on the inner peripheral wall. Also, a ring-shaped first seal pressing member 32 is fitted on the inner peripheral wall of the card accommodating cavity 13*a* in front of the first seal member 31 to keep the first seal member 31 from becoming detached from the inside of the card accommodating cavity 13*a*. As shown in FIG. 4, when the opposing unit 201 is mated with the forward portion 11*a*, the space (gap) between the outer peripheral wall of the inserted portion 211*b* and the inner peripheral wall of the card accommodating cavity 13*a* is sealed in a water-tight manner by the first seal member 31. As a result, the opposing unit 201 is mated with the first housing 11 in a water-tight manner.

A second housing accommodating cavity 13*b* with an opening in the rear end is formed in the rear portion 11*b*. The front end of the second housing accommodating cavity 13*b* is defined by the first terminal holding portion 12. The rear ends of the tail portions 51*d* of the first terminals 51 protrude to the rear beyond the rear end of the first terminal holding portion 12, and are positioned inside the second housing accommodating cavity 13*b*.

The second housing 111 has a rear portion 111*a*, a skirt portion 111*b*, and a forward portion 111*c*. A plurality of second terminal accommodating holes 111*e* arranged side by side in the transverse direction in two levels, an upper level and a lower level, and extending in the longitudinal direction are formed in the forward portion 111*c*. Each second terminal accommodating hole 111*e* passes through the forward portion 111*c* in the longitudinal direction, and accommodates and holds a second terminal 151 inside. It also accommodates some of the leading end of the conductive wire 191 connected to the second terminal 151.

A ring-shaped second seal portion 132 made of an elastic resin such as rubber is fitted over the outer peripheral wall of the forward portion 111*c*, and a second seal pressing member 112 is fitted to the front of the second seal member 132 to keep the second seal member 132 from becoming detached from the forward portion 111*c*. The second seal pressing member 112 is open on the rear end, and the front end is sealed by a front wall 112*a* to form a bottomed cylindrical member. This is fitted over the forward portion 111*c*.

A plurality of first terminal through-holes 112*b* and second terminal auxiliary accommodating holes 112*c* are formed in the front wall 112*a* in positions corresponding to each of the second terminal accommodating holes 111*e*, and pass through the front wall 112*a* in the longitudinal direction. Each first terminal through-hole 112*b* opens into the front surface of the front wall 112*a*, each second terminal auxiliary accommodating hole 112*c* opens into the rear surface of the front wall 112*a*, and the first terminal through-holes 112*b* and second terminal auxiliary accommodating holes 112*c* communicate with each other. Each second terminal auxiliary accommodating hole 112*c* has the same diameter as a second terminal accommodating hole 111*e*, and the section of the contact portion 151*c* of a second terminal 151 protruding forward from a second terminal accommodating hole 111*e* is accommodated therein. Each first terminal through-hole 112*b* has a diameter smaller than that of the second terminal accommodating holes 111*e* and is able to receive the tail portion 51*d* of a first terminal 51. The diameter does not allow the contact portion 151*c* of a second terminal 151 to pass through. As a result, the first terminal through-holes 112*b* function as stoppers preventing the forward displacement of second terminals 151.

A retainer 121 is attached to the forward portion 111*c*. The retainer 121 abuts the rear end of the lower contact portion 151*c*2 of each contact portion 151*c* described below to prevent rearward displacement of the second terminals 151. A lance 111*f* or tongue-shaped portion whose front end is biased upward is formed in the front end portion of the lower wall of each second terminal accommodating hole 111*e*. The lance 111*f* abuts the rear end of the protruding portion 151*c*3 of the contact portion 151*c* of each second terminal 151 in the section positioned in front of the second terminal accommodating hole 111 to be explained below and serves as a stopper preventing rearward displacement of the second terminals 151.

A rear cavity 111*a*1 with an opening in the rear end is formed in the rear portion 111*a*, and a third seal member 131 made of an elastic resin such as rubber is fitted inside the rear cavity 111*a*1. A third seal pressing member 113 is fitted to the rear of the third seal member 131 to keep the third seal member 131 from becoming detached inside the rear cavity 111*a*1. A plurality of conductive wire sealing through-holes 131*a* and conductive wire through-holes 113*b* are formed in the third seal member 131 and the third seal pressing member 113 in positions corresponding to the second terminal accommodating holes 111*e*, and are formed so as to pass through the third seal member 131 and the third seal pressing member 113 in the longitudinal direction. As shown in FIG. 4 and FIG. 5, the third seal pressing member 113 presses the third seal member 131 from the rear so that the third seal member 131 forms a water-tight seal on the inner peripheral wall of the rear cavity Mal, the rear surface of the forward portion 111*c* inside the rear cavity 111*a*1, and surrounding each conductive wire 191. In this way, the conductive wires 191 are connected to the second housing 111 in a water-tight manner.

The skirt portion 111*b* includes a flange portion 111*b*1 integrally formed in the outer peripheral wall of the forward portion 111*c* and extending outward from the outer peripheral wall, and a tube portion 111*b*2 extending forward from the leading end of the flange portion 111*b*1. An annular recessed groove portion 111*d* is formed between the inner peripheral wall of the tube portion 111*b*2 and the outer peripheral wall of the forward portion 111*c*, and the second seal member 132 is positioned inside the recessed groove portion 111*d*.

When the first housing 11 and the second housing 111 are connected, a section near the rear end of the rear portion 11*b* of the first housing 11 is fitted into the recessed groove portion 111*d*. In this way, the gap between the inner peripheral wall of the second housing accommodating cavity 13*b* and the outer peripheral wall of the forward portion 111*c* in the rear portion 11*b* is sealed by the second seal member 132 in a water-tight manner. In this way, the first housing 11 and the second housing 111 are connected in a water-tight manner. Because a wear-resistant second seal member 132 is interposed in a compressed state between the inner peripheral wall of the second housing cavity 13*b* and the outer peripheral wall of the forward portion 111*c*, the second housing accommodating cavity 13*b* and the forward portion 111*c*, and thus the first housing 11 and the second housing 111, reliably remain in a connected state.

Also, when the first housing 11 and the second housing 111 are connected, the forward portion 111*c* of the second housing 111 and the second seal pressing member 112 attached to the outside of the forward portion 111*c* are inserted into and accommodated inside the second housing accommodating cavity 13*b* of the rear portion 11*b*. Then, the rear end of the tail portion 51*d* of each first terminal 51 protruding to the rear from the rear end of the first terminal holding portion 12 passes through a first terminal through-hole 112*b* formed in the front wall 112*a* of the second seal pressing member 112, enters a second terminal auxiliary accommodating hole 112*c*, and engages and contacts the contact portion 151*c* of a second terminal 151. In this way, each first terminal 51 establishes an electrical connection with the conductive wire 191 via a second terminal 151.

The following is a detailed description of the configuration of the second housing 111.

Figure 7:
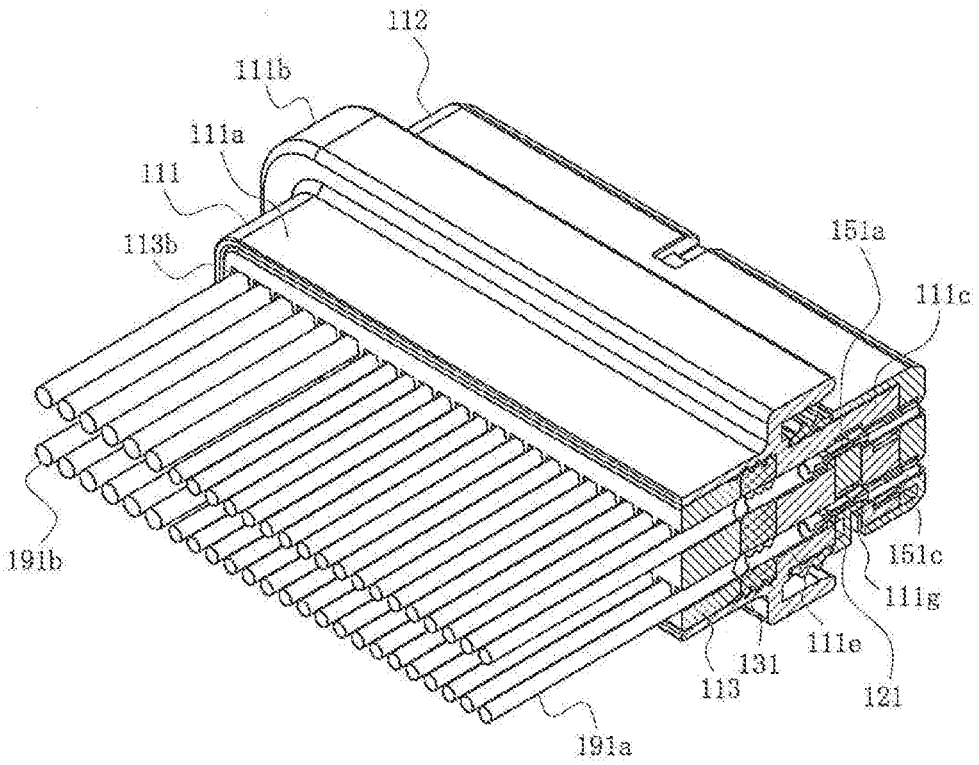
FIG. 7 is a cutaway perspective view of the second housing in the card edge connector of the present embodiment from arrows C-C in FIG. 6B.
Figure 8:
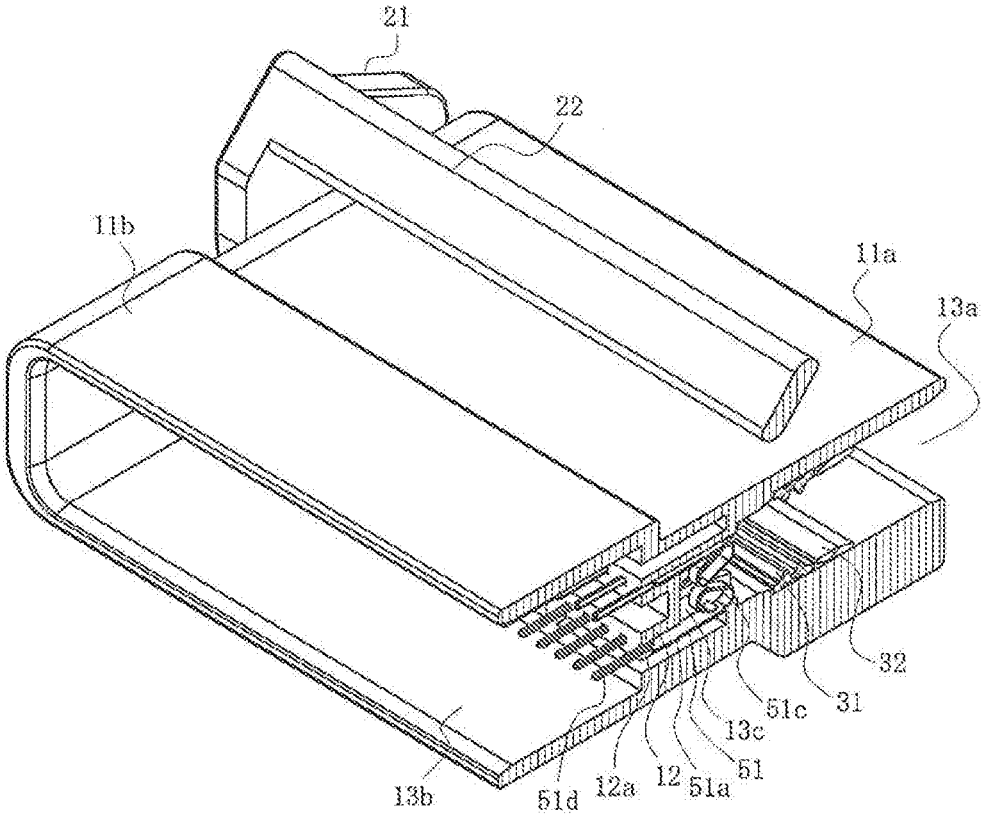
FIG. 8 is a cutaway perspective view of the second housing in the card edge connector of the present embodiment from arrows D-D in FIG. 6B.

As shown in FIG. 7, the contact portion 151*c* of each second terminal 151 is an angular tube-shaped member connected integrally to the leading end of the main body portion 151*a*. As shown in FIGS. 9A and 9B, each contact portion 151*c* includes a cantilevered contact spring portion 151*c*1 extending downward at an angle from the middle of the upper wall of the angular tube, a slender panel-like lower contact portion 151*c*2 abutting the lower wall of the tube and extending in the longitudinal direction, and a protruding portion 151*c*3 protruding downward from the lower contact portion 151 *c*2 at the leading end of the angular tube. The protruding portion 151*c*3 is positioned in front of the second terminal accommodating hole 111*e* inside a second terminal auxiliary accommodating hole 112*c* formed in the front wall 112*a* of the second seal pressing member 112.

When the first housing 11 and the second housing 111 are connected, the rear end of the tail portion 51*d* of each first terminal 51 passes through a first terminal through-hole 112*b* formed in the front wall 112*a* of the second seal pressing member 112, and enters a second terminal auxiliary accommodating hole 112*c* and the angular tube of the contact portion 151*c* accommodated inside a second terminal accommodating hole 111*e*. The rear end of the tail portion 51*d* is inserted between the free end or leading end of the contact spring portion 151*c*1 and the lower contact portion 151*c*2, and the interval between the leading end of the contact spring portion 151*c*1 and the lower contact portion 151*c*2 is pushed apart. In this way, the contact spring portion 151*c*1 is elastically deformed, and exerts spring action that works with the lower contact portion 151*c*2 to forcibly interpose the rear end of the tail portion 51*d* from above and below. As a result, contact pressure occurs between the contact portion 151*c* and the tail portion 51*d*, and the contact portion 151*c* and the tail portion 51*d* can be reliably kept in good contact with each other.

As mentioned above, the rear end of the protruding portion 151*c*3 abuts the leading end of the lance 111*f* formed in the front end portion of the lower wall of a second terminal accommodating hole 111*e*, and this keeps the contact portion 151*c* of the second terminal 151 from getting displaced to the rear. Also, as mentioned above, the rear end of the lower contact portion 151*c*2 abuts the retainer 121, keeping the contact portion 151*c* of a second terminal 151 from being displaced to the rear.

Figure 10A:
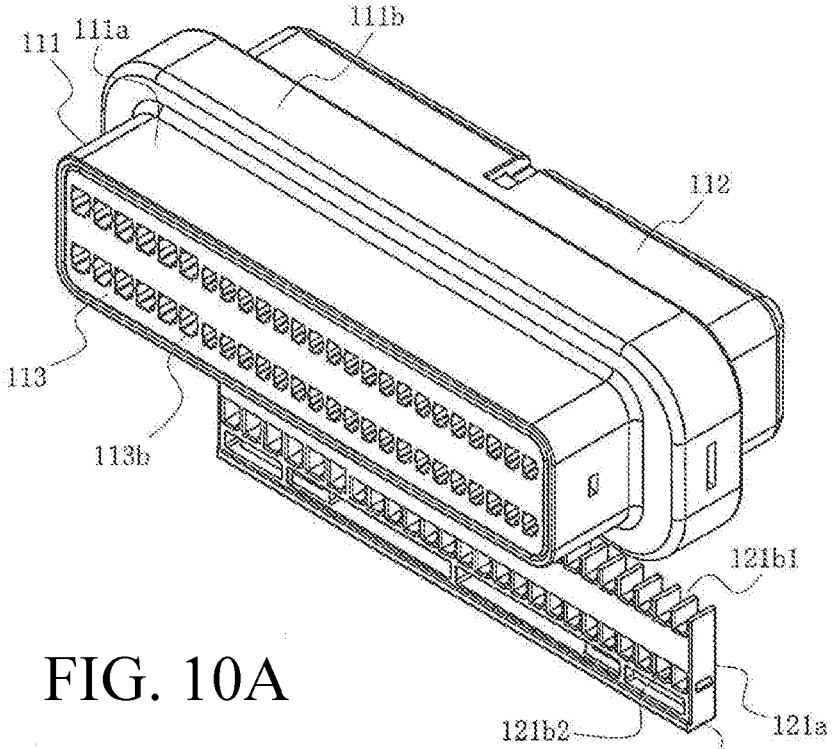
Figure 10B:
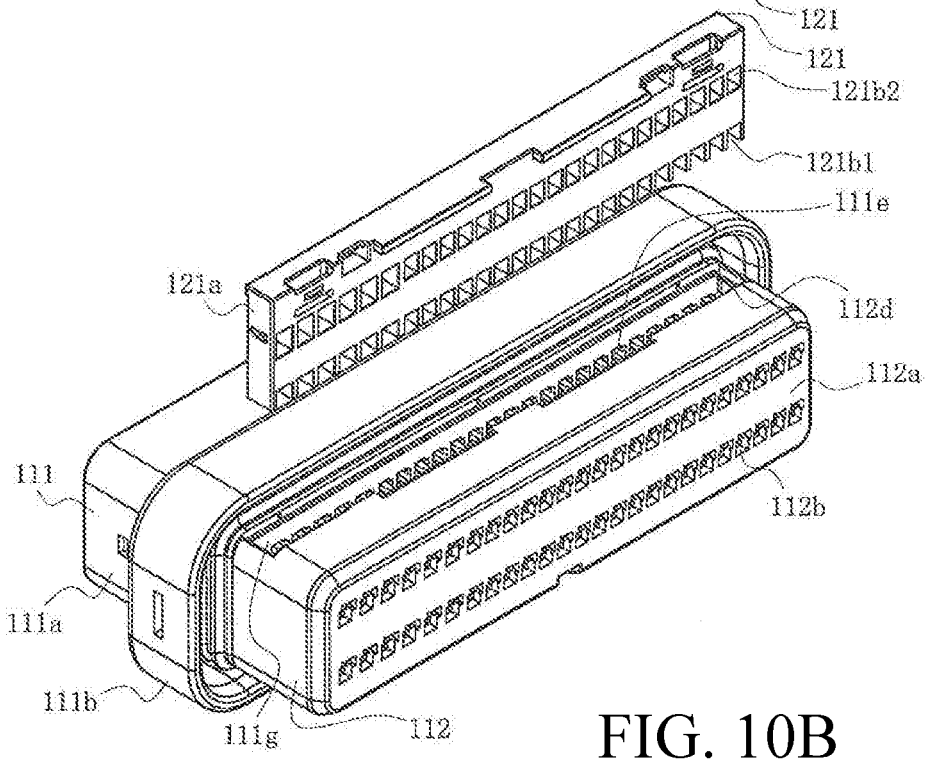
Figure 11:
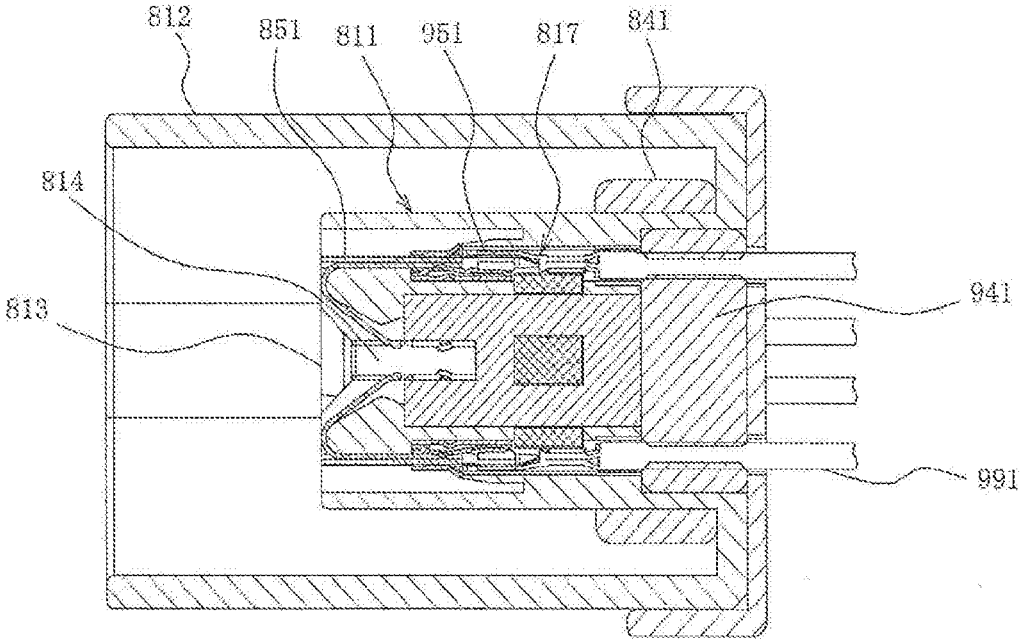
FIG. 11 Prior Art
FIG. 11 is a cross-sectional view of a card edge connector of the prior art.

The retainer 121 in the present embodiment is the member shown in FIGS. 10A and 10B, and has a flat main body portion 121*a* and a plurality of upper terminal through-holes 121*b*1 and lower terminal through-holes 121*b*2 passing through the main body portion 121*a* in the thickness direction. The upper terminal through-holes 121*b*1 have a diameter substantially equal to the diameter of the second terminal accommodating holes 111*e* and are positioned so as to correspond to the second terminal accommodating holes 111*e* arranged above. The lower terminal through-holes 121*b*2 have a diameter substantially equal to the diameter of the second terminal accommodating holes 111*e* and are positioned so as to correspond to the second terminal accommodating holes 111*e* arranged below.

A slit-shape retainer accommodating recessed portion 111*g* extending in the transverse and vertical directions is formed in the forward portion 111*c* of the second housing 111. The retainer accommodating recessed portion 111*g* is open in the lower surface of the forward portion 111*c*. A lower surface opening 112*d* corresponding to the retainer accommodating recessed portion 111*g* is also formed in the lower surface of the second seal pressing member 112. In the orientation shown in FIGS. 10A and 10B, the retainer 121 rises from below the second housing 111 and is inserted into the retainer accommodating recessed portion 111*g*.

When the retainer 121 is in the closed position, as shown in FIG. 9B, each upper terminal through-hole 121*b*1 and lower terminal through-hole 121*b*2 is aligned with the corresponding second terminal accommodating hole 111*e* so that second terminals 151 can pass through the upper terminal through-holes 121*b*1 and the lower terminal through-holes 121*b*2. When the retainer 121 is in the open position, second terminals 151 connected to the leading ends of conductive wires 191 move from the rear of the second housing 111 and are inserted into the second terminal accommodating holes 111*e*. In the open position, the lower end surface of the retainer 121 protrudes below the lower surface of the second seal pressing member 112.

When the retainer 121 has risen from the open position and reached the closed position shown in FIG. 9A, the bottom surface of each upper terminal through-hole 121*b*1 and lower terminal through-hole 121*b*2 is positioned above the bottom surface of the corresponding second terminal accommodating hole 111*e*. In this way, the rear end of the lower contact portion 151*c*2 in the contact portion 151*c* of each second terminal 151 abuts the retainer 121, preventing displacement of the contact portion 151*c* of the second terminals 151 to the rear. In the closed portion, the lower end surface of the retainer 121 is flush with the lower surface of the second seal pressing member 112. Therefore, as shown in FIG. 5, the forward portion 111*c* of the second housing 111 and the second seal pressing member 112 attached to the outside of the forward portion 111*c* can be inserted into and accommodated inside the second housing accommodating cavity 13*b* in the rear portion 11*b* of the first housing 11, and the first housing 11 and the second housing 111 can be connected.

When the first housing 11 and the second housing 111 are connected, the lower end surface of the retainer 121 faces the inner wall surface of the rear portion 11*b* of the first housing 11, and the retainer 121 cannot be displaced downward. In other words, the retainer 121 is locked in the closed position. Because the retainer 121 is positioned downstream from the second seal member 132 in the passage between the first housing 11 and the second housing 111 from the outside to the inside, that is, in the passage shown in FIG. 5 extending from the front end of the tube portion 111*b*2 of the skirt portion 111*b* of the second housing 111 via the inner wall surface of the tube portion 111*b*2, the front surface of the flange portion 111*b*1, and the outer peripheral wall of the forward portion 111*c*, the retainer 121 is blocked from the outside in an air-tight manner, and water cannot enter the gap between the retainer 121 and the surrounding components.

In the present embodiment, the connector 1 includes a housing 10 mated with an opposing unit 201 having connecting electrode pads 251, the housing 10 comprises a first housing 11 having first terminals 51 mounted to contact the electrode pads 251 and a second housing 111 having second terminals 151 connected to a core wire in a conductive wire 191, and the first terminals 51 and the second terminals 151 contact each other under a predetermined amount of contact pressure when the first housing 11 and the second housing 111 are connected.

When the first housing 11 and the second housing 111 are connected in this manner, a connector 1 can be obtained with a housing 10 that is mated with the opposing unit 201. Therefore, even though the first terminals 51 and the second terminals 151 are subjected to high contact pressure when making contact with each other, a connector 1 can be easily and properly obtained in a short period of time. This makes the connector 1 assembly process easier and reduces manufacturing costs. Because the first terminals 51 and the second terminals 151 are subjected to high contact pressure when making contact with each other, the connection between the first terminals 51 and the second terminals 151 is reliable, and the durability and reliability of the connector 1 are improved.

Also, the opposing unit 201 is mated with the first housing 11 in a water-tight manner, the conductive wires 191 are connected to the second housing 111 in a water-tight manner, and the first housing 11 and the second housing 111 are connected in a water-tight manner. Therefore, the connector 1 can be used for a long period of time in a harsh environment with high humidity and a large amount of rainfall.

Also, the first housing 11 includes a second housing accommodating cavity 13*b* having an opening in the rear end, and a first terminal holding portion 12 positioned on the front end of the second housing accommodating cavity 13*b*, each first terminal 51 has a main body portion 51*a* held by the first terminal holding portion 12, and a tail portion 51*d* extending to the rear from the rear end of the main body portion 51*a*, at least the rear end protruding into the second housing accommodating cavity 13*a* to the rear of the first terminal holding portion 12, the second housing 111 includes a forward portion 111*c* having second terminal accommodating holes 111*e* for holding the second terminals 151, each second terminal 151 has a main body portion 151*a* connected to a core wire of the conductive wire 191, and a contact portion 151*c* connected to the leading end of the main body portion 151*a*, and the forward portion 111*c* being housed inside the second housing accommodating cavity 13*b* and the tail portions 51*d* contacting contact portions 151*c* when the first housing 11 and the second housing 111 are connected. As a result, the first terminals 51 and the second terminals 151 can be connected simply by connecting the first housing 11 to the second housing 111 even when contact pressure has been increased to bring the tail portions 51*d* of the first terminals 51 into contact with the contact portions 151*c* of the second terminals 151. This makes connecting the first terminals 51 and the second terminals 151 easier, and the operation takes less time.

Also, the second housing 111 has a retainer 121 able to move between an open position enabling the second terminals 151 to move and a closed position preventing movement of the second terminals 151. Here, the retainer 121 is unable to move in the closed position when the first housing 11 and the second housing 111 are connected. This reliably keeps the second terminals 151 from becoming detached from the second housing 111 even when the conductive wire 191 is subjected to external force such as tension.

Also, each first terminal 51 has a contact portion 51*c* contacting an electrode pad 251 when the opposing unit 201 is mated with the first housing 11, each contact portion 51*c* has a contact flat portion 51*c*2 as well as a first curved portion 51*c*1 and a second curved portion 51*c*3 connected to both ends of the contact flat portion 51*c*2 whose side profile resembles a semi-circle, and the first curved portion 51*c*1 and the second curved portion 51*c*3 function as a spring when the contact flat portion 51*c*2 contacts an electrode pad 251. Therefore, because both ends of the contact flat portion 51*c*2 is supported by a soft spring, the amount of distortion in the contact pressure with the electrode pad is reduced even when the amount of displacement is significant. This maintains reliable contact with the electrode pad 251 even when there is some discrepancy in the position of the electrode pad 251.

In the disclosure of the present specification, characteristics related to specific preferred embodiments were described. A person of ordinary skill in the art could naturally devise other embodiments, modifications, and variations with reference to the disclosure of the present specification without departing from the spirit and scope of the appended claims.

The disclosure can be applied to a card edge connector.

The invention claimed is:

1. A card edge connector comprising:

a housing configured to be mated with a card having connecting electrodes, the housing comprising a first housing having first terminals mounted to contact the connecting electrodes and a second housing having second terminals each connected to a core wire in a conductive wire, and the first terminals and the second terminals contacting each other under a predetermined amount of contact pressure when the first housing and the second housing are mated.

2. A card edge connector according to claim 1, wherein the card is mated with the first housing in a water-tight manner, the conductive wire is connected to the second housing in a water-tight manner, and the first housing and the second housing are connected in a water-tight manner.

3. A card edge connector according to claim 1, wherein the first housing includes a second housing accommodating cavity having an opening in the rear end, and a first terminal holding portion positioned on the front end of the second housing accommodating cavity, each first terminal has a main body portion held by the first terminal holding portion, and a tail portion extending to the rear from the rear end of the main body portion, at least the rear end protruding into the second housing accommodating cavity to the rear of the first terminal holding portion, the second housing includes a forward portion having second terminal accommodating holes for holding the second terminals, each second terminal has a main body portion connected to a core wire of the conductive wire, and a contact portion connected to the leading end of the main body portion, and the forward portion being housed inside the second housing accommodating cavity and the tail portions contacting contact portions when the first housing and the second housing are connected.

4. A card edge connector according to claim 1, wherein the second housing has a retainer able to move between an open position enabling the second terminals to move and a closed position preventing movement of the second terminals, the retainer being unable to move in the closed position when the first housing and the second housing are connected.

5. A card edge connector according to claim 1, wherein each first terminal has a contact portion contacting a respective connecting electrode when the card is mated with the first housing, each contact portion has a contact flat portion as well as a first curved portion and a second curved portion connected to both ends of the contact flat portion whose side profile resembles a semi-circle, and the first curved portion and the second curved portion function as a spring when the contact flat portions contact the connecting electrode.

* * * * *